United States Patent [19]

Rajala

[11] Patent Number: 5,071,543

[45] Date of Patent: Dec. 10, 1991

[54] METHOD OF SCREENING PULP AND A SCREENING APPARATUS

[75] Inventor: Veli-Matti Rajala, Tampere, Finland

[73] Assignee: Oy Tampella Ab, Tampere, Finland

[21] Appl. No.: 478,652

[22] Filed: Feb. 9, 1990

[30] Foreign Application Priority Data

Feb. 16, 1989 [FI] Finland ..... 890756

[51] Int. Cl.[5] ..... B07B 1/20

[52] U.S. Cl. ..... 209/273; 209/306; 162/55; 162/380

[58] Field of Search ..... 162/55, 251, 380; 210/413, 414, 415; 209/273, 305, 306

[56] References Cited

U.S. PATENT DOCUMENTS

| | | | |
|---|---|---|---|
| 3,255,883 | 6/1966 | Nelson et al. | 209/273 |
| 3,759,392 | 9/1973 | Syrjanen | 210/415 |
| 3,865,243 | 2/1975 | Salminen | 210/415 |
| 3,953,325 | 4/1976 | Nelson | 209/273 |
| 3,970,548 | 7/1976 | Seifert et al. | 209/306 |
| 4,188,286 | 2/1980 | Holz | 210/415 |
| 4,213,823 | 7/1980 | Wittig et al. | 162/380 |
| 4,396,502 | 8/1983 | Justus | 210/415 |
| 4,919,797 | 4/1990 | Chupka et al. | 209/306 |

*Primary Examiner*—Richard V. Fisher
*Assistant Examiner*—Todd J. Burns
*Attorney, Agent, or Firm*—Ladas & Parry

[57] ABSTRACT

The invention relates to a method and a screening apparatus (1) for screening pulp. In the method, the maximum length of fibres and shives flowing through holes (4*a*) in a screen drum (4) is adjusted by moving blades (8) with a sharp front edge close to the surface of the screen drum (4) in such a manner that the sharp edge (8*a*) of the front face moving closest to the drum surface strikes shives or long fibers passing through the hole (4*a*) and pulls them back. The rate of travel of the blades (8) is so adjusted that the pulp flows in the hole (4*a*) only over a distance corresponding to the predetermined fiber length during the interval between the front edge of two successive blades (8). The screening apparatus (1) comprises blades (8) moving in parallel with the surface of the screen drum (4). The front edge of the blades defines in cross-section a sharp angle, the point of the angle defined by the front edge moving closest to the surface of the screen drum (4).

4 Claims, 2 Drawing Sheets

METHOD OF SCREENING PULP AND A SCREENING APPARATUS

Figure 1:
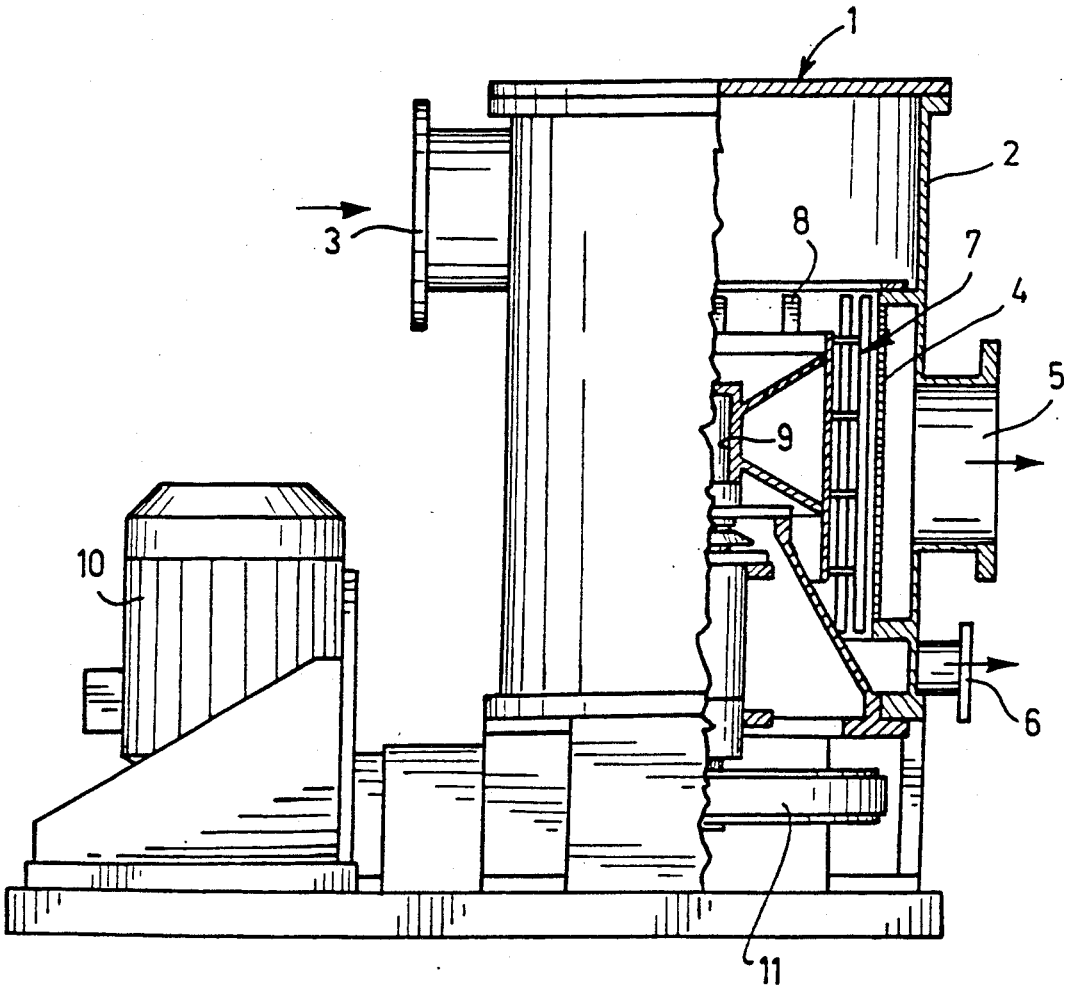

The invention relates to a method of screening pulp, wherein pulp is fed to one end of a substantially cylindrical screen drum provided with holes and then passed to one drum surface, whereby an acceptable pulp fraction flows through the holes of the screen drum to be removed from its other side, and a rejected pulp fraction is removed from the other end of the screen drum, and wherein blades are moved close to that surface of the screen drum to which the pulp is fed, a blade face facing the screen drum being arranged to diverge from the surface of the screen drum backwards in the direction of travel of the blade, the surface of the screen drum on the side of the blades being kept free from particles which do not pass through the holes by means of pressure impulses created by the blades.

The invention is also concerned with a screening apparatus for screening pulp, comprising a substantially cylindrical screen drum provided with openings such as holes or the like, and blades moving close to one surface of the screen drum in parallel with it to keep said surface clean, a blade face facing the screen drum being arranged to diverge from the surface of the screen drum backwards in the direction of travel of the blade, whereby the pulp is passed from one end of the screen drum to its surface on the side of the blades so that an acceptable pulp fraction flows through the holes of the screen drum to its other side to be discharged therefrom and a rejected pulp fraction is removed from the other end of the screen drum.

Pulp to be screened is introduced into a screening apparatus to be passed therein through a screen drum provided with holes or slits such that fibres of a desired size only are able to pass through them while too large fibres, shives and other particles are passed from one drum end to the other to be removed as a reject fraction and passed to further refining. The flow of pulp through the holes causes the holes to be easily clogged by particles which are not able to pass through the holes. For this reason the screening apparatuses are provided with blades moving close to the screen surface. The cross-sectional shape of such blades resembles mainly the wing profile of an aeroplane. The shape is usually such that it causes pressure impulses to occur in the pulp both from inside the screen drum to the outside and in the opposite direction, whereby too large fibres and other particles stuck in the holes are released and the screen surface remains clean. A problem with prior art apparatuses, some of them disclosed, e.g., in FI Pat. No. 56 217, DE Offenlegungsschrift 11 31 081 and U.S. Pat. No. 2,835,173, is that very thin but long shives formed during the production of pulp are able to pass through large-hole screens, wherefore screens provided with very small holes have to be used for separating such long shives from an acceptable pulp fraction. As the modern paper producing techniques require a high degree of purity from the pulp, it has been necessary to use smaller holes and in some cases the holes have been replaced with slits having a width as small as 0.25 mm. Such narrow slits are very expensive to manufacture in addition to which the screening capacity of the screening apparatus decreases with such small slit sizes because the proportion of slits to the surface area of the screen drum in screen drums with narrow slits is smaller than in screen drums with large holes or wider slits. As a result, a greater number of screening apparatuses has to be used to achieve a desired capacity, which increases costs.

The object of the present invention is to provide a method and a screening apparatus which enable the provision of larger holes or wider slits in screen drums while maintaining sufficient screen capacity and a sufficiently high degree of purity of the screened pulp. The method of the invention is characterized in that to prevent the flow of long fibres and shives through the holes of the screen drum with the acceptable fraction, the front face of the blades moving close to said surface of the screen drum forms in cross-section a substantially acute angle with said blade face, said front face pulling the long fibres at the holes back on to the surface of the screen drum on the side of the blades.

It is essential in the method that the pulp flowing through the holes or slits of the screen surface is exposed at each hole or slit to a force acting on a shive or other possible impurity so as to pull it out of the hole or slit, and in addition, to a vacuum impulse acting through the hole or slit from the side of the screened pulp toward the pulp to be screened at such a frequency in relation to the flow rate of the pulp that only fibres or shives of a predetermined length are able to pass through the hole or slit during the intervals between the impulses. An advantage of the method is that it can be determined on the basis of the flow rate of the pulp what is the maximum length of an acceptable fibre, whereafter the rate of rotation of the blades is adjusted so that the pulp flows during the interval between two impacts made the blades in the direction of the hole only over a distance corresponding to the predetermined maximum length of an acceptable fibre. The degree of purity of the pulp can thereby be adjusted as desired while the capacity of the screening apparatus is sufficient due to the larger holes or slits.

The screening apparatus of the invention is characterized in that the front face of the blades of the screening apparatus and said blade face facing the screen drum form in cross-section a substantially acute angle opening against the direction of travel of the blades, the acute-angled edge moving closest to the surface of the screen drum so that the front face of the blades pulls the long fibres at the hole back on to the surface of the screen drum on the side of the blades.

It is essential in the invention that the blades of the screening apparatus define a point angle, that is, the blades comprise a sharp edge. The sharp edge moves close to the surface of the screen cylinder on the side of the pulp to be screened. It is also essential that the blade face facing the screen cylinder diverges from the cylinder in the direction away from the edge toward the rear part of the blade, so that when the sharp edge of the blade strikes a shive, it pulls it away from the hole while the vacuum impulse created by the diverging blade face makes the removal of shives and other impurities even more efficient. Furthermore, it is essential in the apparatus of the invention that the number and rate of rotation of the blades is so dimensioned or so adjustable that the edges of two successive blades reach one particular hole at such a frequency in relation to the flow rate of the pulp flowing through the hole that the pulp flows in the hole only over a distance corresponding to the predetermined maximum length of an acceptable fibre.

Figure 2A:
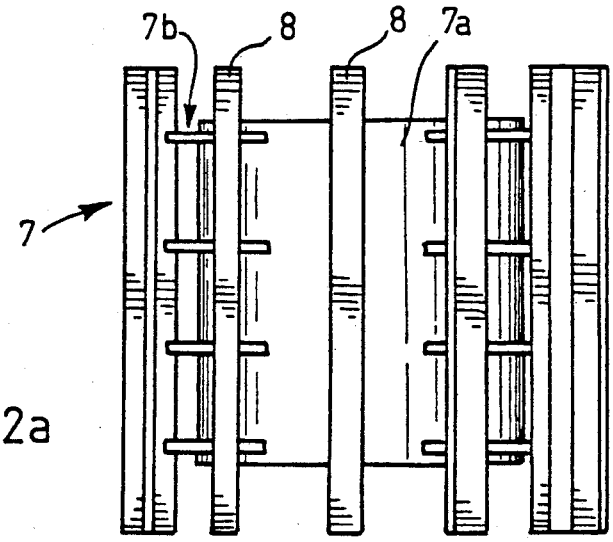
Figure 2B:
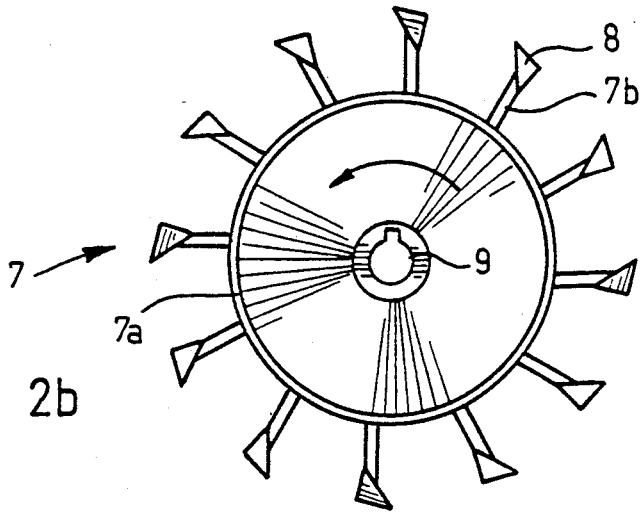
Figure 3:
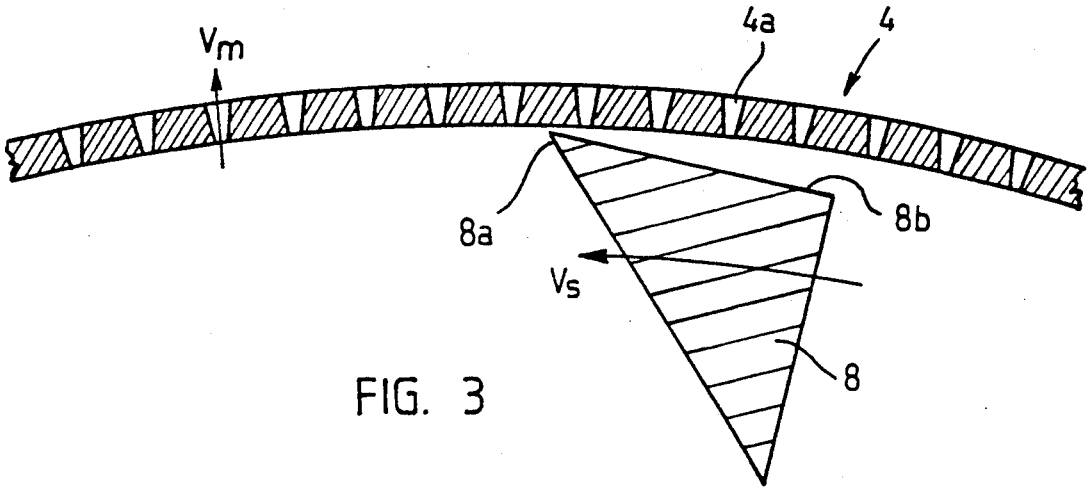

The invention will be illustrated in greater detail in the attached drawings, wherein FIG. 1 is a partial sectional view of a screening apparatus of the invention;

FIG. 2*a* and 2*b* illustrate the rotor construction of the screening apparatus of the invention as seen from the side and in the direction of its shaft; and FIG. 3 is a more detailed view of the position of one blade of the screening apparatus with respect to the screen cylinder.

FIG. 1 shows generally a screening apparatus 1 comprising an outer shell 2. Pulp is introduced into the screening apparatus through an inlet 3 from which it is passed into the inner space of a screen drum 4 disposed within the screening apparatus. The screen drum 4 is provided with openings 4*a* which may be holes or slits. An acceptable pulp fraction passed through the holes is discharged through a discharge opening 5 while a reject fraction containing shives, impurities, fibre bunches and other such too large particles is passed downward in the axial direction of the screen drum 4 so as to be removed through a reject opening 6. To improve the efficiency of the screening process, a rotor 7 comprising blades 8 is mounted within the screen drum 4 so as to rotate concentrically with the screen drum 4 about a shaft 9. The screening apparatus comprises a motor 10 arranged to rotate the rotor 7 by V belts or the like 11.

In FIGS. 2*a* and 2*b*, the rotor 7 is shown from the side and in the direction of the shaft, respectively. The rotor 7 comprises a frame cylinder 7*a* and blades 8 attached to the frame cylinder at a distance from its surface by means of support arms 7*b*. FIG. 3 shows in greater detail the position of one blade 8 with respect to the screen drum 4 and its holes 4*a*. In FIGS. 2*b* and 3, the blade is triangular in shape and its front face forms in cross-section an acute angle with a blade face 8*b* facing the screen drum, that is, a sharp edge 8*a*. The blade is mounted so that the front face with the sharp edge moves first in the direction of travel. Correspondingly, the blade face 8*b* facing the screen drum 4 is so positioned relative to the screen drum that its distance from the surface of the screen drum increases with the distance from the edge 8*a*, that is, backwards in the direction of travel.

During the rotation of the rotor 7 the blades 8 move along the surface of the screen drum 4, whereby the edge 8*a* of each blade 8 reaches each hole 4*a* at a frequency proportional to its rate of travel. If too long a shive or fibre is passing through the hole at the moment when the edge 8*a* of the blade 8 reaches the hole, the sharp edge 8*a* strikes the shive and displaces it with it so that it is returned to that side of the screen drum where the blades are positioned. Correspondingly, the vacuum impulse created by the blade face 8*b* further facilitates the returning of the shive and the releasing of fibre bunches, shives, impurities and the like particles from the holes 4*a*. The edge 8*a* of each blade 8 effects a similar phenomenon at each hole, so it can be predetermined on the basis of the number of the blades 8 and the rate of rotation of the rotor 7 what is the maximum length of acceptable fibres. If the flow rate Vm of the pulp in the hole 4*a* is one metre per second and the impact frequency of the blades 8 at each hole 4*a* is 100 Hz, determined by the rate of rotation Vs of the rotor and thus by the rate of travel of the blades, the maximum length of a fibre able to pass through one particular hole during the interval between the impacts of two successive blade edges is 10 mm whereas fibres and shives longer than that are pulled back inside the screen drum so as to be removed with the reject through the lower end of the screen drum.

By means of the above solution, the size of the holes or slits of the screen drum can be considerably larger than previously because the screening capacity is not dependent on the size of the holes or slits only but it can be affected by suitably selecting the impact frequency of the blades. As a result, the cost of manufacture is decreased and the screening capacity can be increased while maintaining the same quality of pulp or even improving it.

The embodiment described above is only one possible embodiment of the method and the screening apparatus according to the invention, and the invention is by no means restricted to it. For instance, the blades of the screening apparatus can vary in shape and their shape can be closer to known blade shapes, provided that the edge of the blade is sharp in cross-section and moves closest to the surface of the screen drum, as described above. The blades need not be positioned on the inside of the screen drum as described above; they can be positioned on its outside as well, in which case the pulp to be screened is fed to the outer surface of the screen drum. The number of the blades can be selected as desired, provided that sufficiently space for a sufficiently free flow of pulp remains between them.

I claim:

1. A method of screening pulp, comprising:

feeding pulp into one end of a substantially cylindrical screen drum (4) and onto one cylindrical surface thereof provided with holes (4*a*);

passing an acceptable fraction of the pulp through the holes (4*a*) of the screen drum (4) for removable from an opposite cylindrical surface thereof; and removing a rejected fraction of the pulp from the one cylindrical surface and an opposite end of the screen drum (4);

wherein the passing and removing comprises:

moving blades (8) close to and in a direction circumferentially along the one cylindrical surface of the screen drum (4), each of the blades having only one blade face (8*b*) facing the one cylindrical surface of the screen drum (4) and diverging therefrom in a direction opposite to the direction of the movement of the blade (8); and providing a front face to each blade that meets a sharp edge (8*a*) of the blade face (8*b*) thereof in the direction of the movement of the blades (8) and forms, in cross section, a sufficiently acute angle (8*a*) with the blade face (8*b*) that the front face pulls long fibres at the holes (4*a*) back into the screen drum (4) to prevent flow of the long fibres or shives through the holes (4*a*) with the acceptable fraction of the pulp.

2. A method according to claim 1, wherein the movement of the blades (8) is at such a rate (Vs) in relation to a flow rate (Vm) of the pulp passing through the holes (4*a*) that the edges (8*a*) of two successive blades (8) reach a particular holes (4*a*) in the screen drum (4) at an interval such that only fibres having a length no more than a predetermined value are in the acceptable fraction.

3. A screen apparatus for screening pulp, comprising:

a substantially cylindrical screen drum (4) means having one cylindrical surface provided with holes (4*a*) for receiving pulp on the one surface;

blades (8) moveable close to and in a direction circumferentially along the one surface of the screen drum (4) for passing an acceptable fraction of the pulp through the holes and removing a rejected fraction of the pulp from the one surface, each blade having only one blade face (8*b*) facing the one surface of the screen drum (4) and diverging therefrom in a direction opposite to the direction of the movement of the blade (8), and a front face that meets a sharp edge (8*a*) of the blade face (8*b*) thereof in the direction of the movement of the blade (8) such that the blade (8) has, in cross section, a substantially acute angle thereat.

4. A screening apparatus according to claim 3, wherein the distance of the blade face (8*b*) at the edge of (8*a*) to the front face of the blade (8) from the one surface of the screen drum (4) is in the range of 0.5 to 1.0 mm.

* * * * *